US008801003B1

(12) United States Patent
Cassidy

(10) Patent No.: US 8,801,003 B1
(45) Date of Patent: Aug. 12, 2014

(54) DECK WHEELED DEVICE

(76) Inventor: Thomas Patrick Cassidy, North Grosvenordale, CT (US)

( * ) Notice: Subject to any disclaimer, the term of this patent is extended or adjusted under 35 U.S.C. 154(b) by 226 days.

(21) Appl. No.: 13/221,199

(22) Filed: Aug. 30, 2011

Related U.S. Application Data

(60) Provisional application No. 61/380,945, filed on Sep. 8, 2010.

(51) Int. Cl.
*A63C 17/22* (2006.01)

(52) U.S. Cl.
USPC ..... 280/11.223; 301/5.306

(58) Field of Classification Search
USPC ..... 280/11.223; 301/5.301, 5.306, 5.7, 301/5.307, 5.308, 5.309, 5.305
See application file for complete search history.

(56) References Cited

U.S. PATENT DOCUMENTS

| | | | | | |
|---|---|---|---|---|---|
| 2,580,489 | A * | 1/1952 | Wagner | 301/5.7 |
| 2,596,771 | A * | 5/1952 | Harbour | 301/5.7 |
| 2,610,897 | A * | 9/1952 | Rebmann | 301/5.7 |
| 2,628,869 | A * | 2/1953 | Whitcomb | 301/5.7 |
| 2,656,220 | A * | 10/1953 | Coldwell | 301/5.7 |
| 2,701,740 | A * | 2/1955 | Norman | 301/5.7 |
| 2,768,862 | A * | 10/1956 | Christensen | 301/5.307 |
| 3,905,649 | A * | 9/1975 | Kosono et al. | 301/5.7 |
| 4,114,952 | A * | 9/1978 | Kimmell | 301/5.7 |
| 4,130,320 | A * | 12/1978 | Scardenzan | 301/5.7 |
| 4,153,303 | A * | 5/1979 | Tanner | 301/64.706 |
| 4,218,098 | A * | 8/1980 | Burton | 301/5.7 |
| 5,308,152 | A * | 5/1994 | Ho | 301/5.304 |
| 5,375,859 | A * | 12/1994 | Peck et al. | 280/11.217 |
| 5,401,038 | A * | 3/1995 | Peck et al. | 280/11.206 |
| 5,470,086 | A * | 11/1995 | Peterson et al. | 280/11.223 |
| 6,105,976 | A * | 8/2000 | Cottle | 280/11.216 |
| 6,131,923 | A * | 10/2000 | Miotto | 280/11.223 |
| 6,176,554 | B1 * | 1/2001 | Huang | 301/5.7 |
| 6,336,685 | B1 * | 1/2002 | Orr | 301/64.701 |
| 6,454,361 | B1 * | 9/2002 | Martin | 301/5.301 |
| 6,880,833 | B2 * | 4/2005 | Polanco | 280/11.221 |
| 7,497,445 | B1 * | 3/2009 | Colgan | 280/11.223 |
| 8,002,361 | B1 * | 8/2011 | Montano et al. | 301/5.307 |
| 2004/0195795 | A1 | 10/2004 | Huang | |
| 2005/0269794 | A1 | 12/2005 | Lukes | |
| 2006/0108857 | A1 * | 5/2006 | Simon et al. | 301/5.301 |
| 2006/0220336 | A1 | 10/2006 | Lin | |
| 2007/0063573 | A1 * | 3/2007 | Szabo et al. | 301/5.306 |
| 2007/0241607 | A1 * | 10/2007 | Hildebrand et al. | 301/5.301 |
| 2007/0262546 | A1 | 11/2007 | Bertiller | |
| 2013/0009448 | A1 * | 1/2013 | Feroussier | 301/5.305 |

* cited by examiner

*Primary Examiner* — Jeffrey J Restifo
(74) *Attorney, Agent, or Firm* — UConn IP Law Clinic; Susan K. Pocchiari; Justin Leisey

(57) ABSTRACT

A deck wheeled device is provided comprising a deck, a subframe connected to at least one point of the deck, at least one truck assembly connected to the subframe, at least one wheel connected to each truck assembly, and at least one spring connecting each truck assembly to the deck. A wheel is provided comprising a tire, two substantially symmetrical hub halves, and at least one bolt that connect the two hub halves together.

12 Claims, 9 Drawing Sheets

SECTION
OF FIG. 2

SECTION
OF FIG. 2

DECK WHEELED DEVICE

This application claims the benefit of U.S. Provisional Application No. 61/380,945, filed Sep. 8, 2010, which provisional application is incorporated herein in its entirety.

BACKGROUND OF THE INVENTION

1. Field of the Invention

The present invention relates to the field of skateboards, particularly to skateboards that have increased functionality to perform maneuvers and tricks.

2. Background Art

Skateboards have existed for many years. Traditional skateboard designs have a flat, elongated deck made of wood capable of supporting a rider, attached to two axle assemblies, or truck assemblies, one at each end of the deck. Some truck assemblies incorporate an elastomeric member which allows the rider to tilt the board relative to the axles, which provides for a basic directional control and turning of the skateboard. Traditional skateboards have four skate wheels made with an elastomeric tire portion, usually made of polyurethane materials, molded around a plastic hub. After considerable use, the skate wheels wear down and need to be replaced. Since the skate wheel's elastomeric tire is molded around the plastic hub, the entire skate wheel is discarded and replaced with a new wheel.

Skateboards serve not only as a means of transportation, but also as recreational equipment. Skateboarding is a popular hobby performed on sidewalks, in the streets, and in dedicated skate parks. Skateboard riders often perform tricks involving jumps, spins, kickflips, and grinds, which require a great deal of balance, skill, and strength.

Thus far, skateboard riders have been limited in their ability to jump. Jumping while on a flat surface requires strong legs to lift the rider as well as the skateboard into the air. Dropping-off from a higher surface to a lower surface requires the rider's legs to absorb the shock from the impact. The deck wheeled device described herein allows the rider to jump higher into the air and to drop-off from greater heights with greater control.

BRIEF SUMMARY OF THE INVENTION

A deck wheeled device is provided comprising a deck, a subframe connected to at least one point of the deck, at least one truck assembly connected to the subframe, at least one wheel connected to each truck assembly, and at least one spring connecting each truck assembly to the deck.

The subframe comprises a spine connected to a saddle member, which creates a stable subframe. The subframe is typically rigid, which gives the rider greater control while riding, as compared to a more flexible subframe. With the saddle and spine assembly being rigid, any angular tilt of the deck relative to the ground will produce a certain turning radius independent of the flexing of the deck or compression of the spring members.

The energy for jumping is provided by the rider and stored in both the deck and the spring members. The deck is preferably designed to flex about the middle of the saddle. The rider uses his weight to push down on the front and back of the deck to flex the deck. The stored energy in the deck and spring member then causes the deck to recoil to propel the rider and the board into the air. The rider is able to jump higher and for greater distances than with a conventional skateboard, without the need for a ramp.

Turns on the device are accomplished similarly to a traditional skateboard. The rider shifts his weight in the direction he wants to turn. The deck of the device can flex when the rider leans toward either side, further facilitating the turning of the board. Additionally, the rider can turn the device by shifting his weight to the back of the deck to lift the front wheels off the ground, and then shifting his weight in the direction of the turn.

A wheel is provided comprising a tire, two substantially symmetrical hub halves, and at least one bolt that connect the two hub halves together. Each side of the tire has an indentation into which fits one hub half. Each hub half has a protruding center such that the centers of each hub half are in contact with each other through the hole in the center of the tire. The tire is held in place between the hub halves by the compressive force of the bolt that connects the two hub halves together and the bolt itself, which can be run through the tire. The wheel design allows a user to quickly change parts that break and change the tires with other tires of various tread designs that a user will choose depending on the surface they are traversing.

LIST OF PARTS

10 Flexible Deck Device or Device
11 Deck
12 Saddle
13 Spine
14 Truck Assembly
15 Spring Member
16 Fasteners
17 Brake
18 Skate Wheel
19 Brake Actuator
20 Brake Cone
21 Brake Cup
22 Hub Halves
23 Fasteners
24 Thermally Insulating Washer
25 Tire

26 Footwear
27 Plate Fastener
28 Pivot Cam
29 Brake Cable
30 Heel Plate
31 Spacer
32 Bearings
33 Riding Surface of Tire 25
34 Sides of Tire 25
36 Hole in Tire 25
37 Indentations of Tire 25
38 Protruding Center of Hub Halves 22
39 Outer Face of Hub Halves 22
40 Inner Face of Hub Halves 22
41 Bulge in Tire 25

DETAILED DESCRIPTION OF THE INVENTION

Detailed embodiments of the present invention are disclosed herein. However, it is to be understood that the disclosed embodiments are merely exemplary of the invention, which may be embodied in various forms, the figures are not necessarily to scale, and some features may be exaggerated to show details of particular components or steps.

Figure 1:
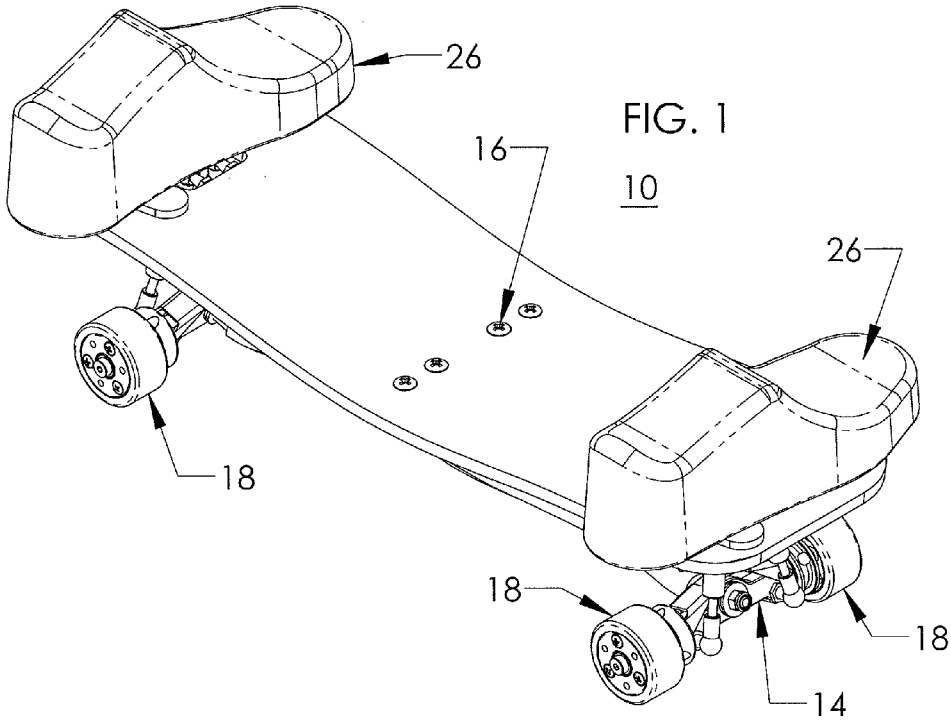
FIG. 1 is an isometric view of the device.
Figure 2:
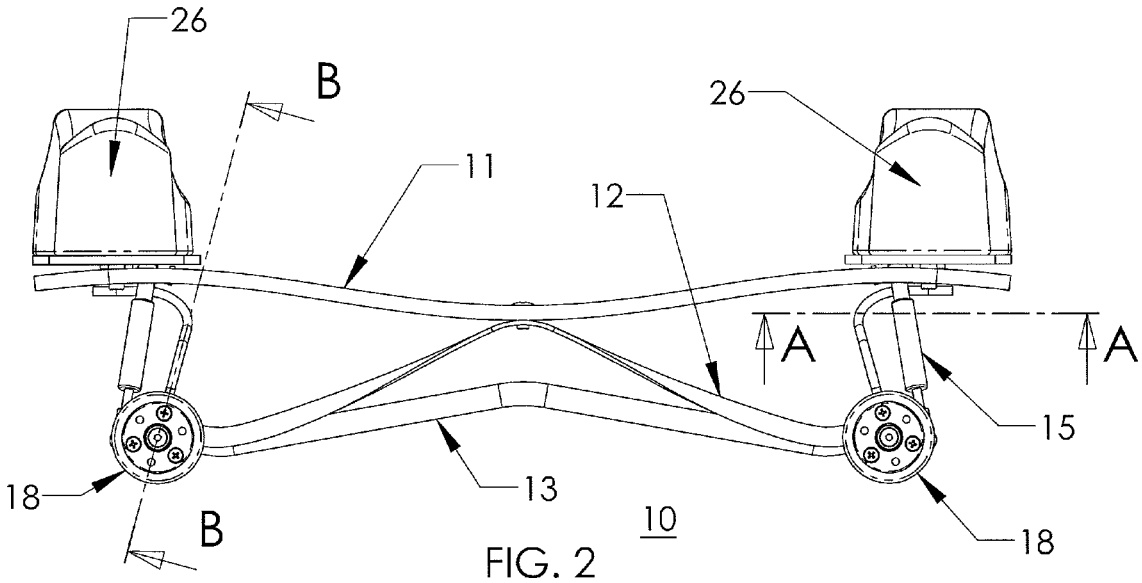
FIG. 2 is a side view of the device.

FIG. 1 is an isometric view of a flexible deck device 10. FIG. 2 is a side view of the device 10 showing the deck 11. The deck 11 can be horizontal and flat, or can be slightly contoured as shown. The contour of deck 11 may be upwards or downwards and may have multiple contours to achieve the correct rider positioning and flex characteristics. For example, a heavier rider may prefer a deck with an upwards contour which flattens out slightly under the rider's weight. This gives the rider a neutral riding position with the bottoms of both of the rider's feet being in the same plane parallel to the ground. Additionally, the deck 11 may naturally be curved upwards when removed from the device 10, so that by flattening the deck 11 and then attaching it to the device 10, the deck 11 has a preloaded force which can help offset the rider's weight and provide better responsiveness to the rider's inputs.

A lighter weight rider may use the same deck design as a heavier rider, but the rider's weight alone may be insufficient to flatten the upwards contour when in a neutral riding position. In this situation, the bottoms of the lighter weight rider's feet would be slightly canted inwards in the normal riding position. If the lighter weight rider jumps from a higher elevation to a lower elevation, the upwards contour of the deck flattens under the rider's weight, and the rider's feet are in a better position to avoid slipping off the board under the shock of the landing.

The stiffness of the deck 11 may be varied depending on the riding terrain, the rider's weight, the rider's ability, and the rider's desired ride comfort. The stiffness of the deck may be measured in terms of its flexural modulus. A higher flexural modulus deck will be stiffer and will resist flexing better than a low flexural modulus deck. The device 10 is designed to allow for interchangeability and replacement of the individual members, so for example, the rider may select the proper deck 11 for his current ability and may replace the deck when his skills improve or if the deck is damaged. Additionally, the spring members 15 may be selected to alter the performance of the device 10. A spring member 15 can be a gas-filled spring, a conventional coil spring, or a combination of both. For a gas-filled spring, altering the gas pressure will change the performance of the spring member 15 and change the overall handling characteristics of the device 10. For a conventional coil spring, altering the spring rate can similarly affect the handling characteristics of the device 10.

The deck 11 can be constructed of wood, plastic, carbon fiber, metal, fiberglass, combinations thereof, or other suitable materials. Wooden decks can be made of solid wood, although plywood laminates are particularly suited for this application due to their low cost and good physical properties, e.g. flexibility. Plywood laminates typically are more resistant to cracking, warping, and shrinking than is solid wood. Plywood laminates can be stiffer and stronger than solid wood, and each layer of the plywood can be oriented at different angles to yield a high strength deck 11 that can withstand the impact of repeated use. Rock Maple and Sugar Maple are two hardwoods that are particularly suitable for this application. Carbon fiber offers a high specific strength or strength to weight ratio and excellent stiffness. The deck 11 can also be made of fiberglass which offers excellent stiffness and low manufacturing and materials costs.

The deck 11 can have a uniform or variable thickness across its side profile. A uniform thickness deck may be cheaper to construct, while a variable thickness deck may offer improved flexing characteristics and rider feedback. The geometry of the deck 11 also can be tailored to achieve the desired flex characteristics. Ridges and rolled edges can be often added to the deck 11 to improve stiffness.

Figure 5:
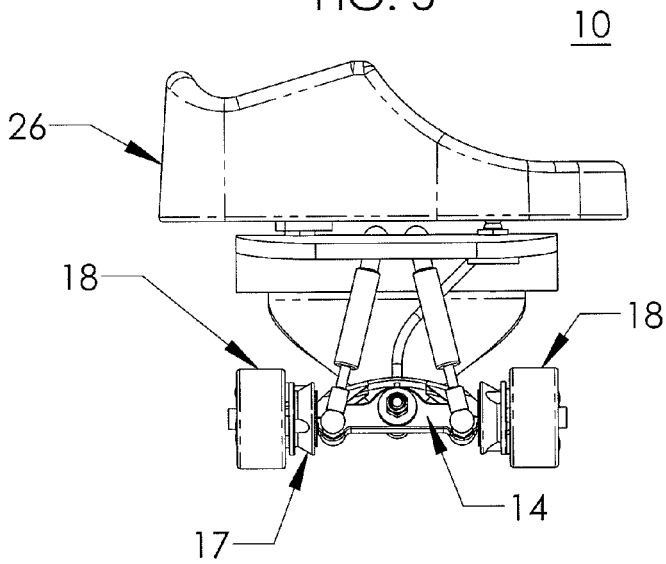
FIG. 5 is a front view of the device.

The device 10 may include footwear 26 attached to the deck 11 for securing the rider's feet atop the deck 11. Footwear 26 may be comprised of custom fitted shoes which fit the particular rider's feet, and which are specially adapted to securely fasten to the device 10. The footwear 26 may also be comprised of bindings, which allows the rider to wear his own shoes. The footwear 26 allows the rider to perform maneuvers with the device 10 without fear of becoming separated from the device 10. The rider's feet will not slip off the deck 11 when jumping or when the rider and device are temporarily inverted. A breakaway fastening system (not shown) may be incorporated into the device 10 to allow the footwear 26 to separate from the deck 11 in the event of an accident, while during normal operation, the footwear 26 remains securely attached. Examples of breakaway fastening systems are commonly found in snow skis and bicycle clipless pedals. Additionally, the footwear 26 allows the rider to selectively actuate a brake 17 as shown in FIG. 5, or provide other selective inputs to the device 10. If the device 10 is fitted with a motor (not shown), the footwear 26 could provide a throttle input to the motor.

FIG. 2 is a side view of device 10 showing a subframe assembly that comprises a saddle 12 and spine 13.

The saddle 12 is a member of the subframe assembly. The saddle 12 can be securely attached at its midpoint to a single point or at multiple points between the two ends of the deck 11 and provides a pivot point about which to flex the deck. The end deflection of the deck 11 about the saddle 12 can measure up to approximately one inch to more than two inches.

To provide the saddle 12 with additional rigidity, the sides of the saddle can be curved to prevent its deformation under the forces exerted by the rider. Additionally, stiffening of the saddle 12 can be accomplished by the use of stiffening ribs which can be stamped into the saddle during manufacture, or by securely attached support members.

The saddle 12 can be constructed out of a variety of materials including metals, plastics, carbon fiber, or fiberglass. The saddle's material of construction should be chosen such that it can be easily formed into a rigid shape, and securely attached to the other members of the device.

The saddle 12 is also securely attached at each of its two endpoints to the spine 13. Depending on the material of construction of the deck 11, saddle 12, and spine 13, the method of joining the members will vary. Metal members can be welded together or connected with fasteners, and many materials can be glued or adhesively bonded to form a secure connection.

The spine 13 is a member of the subframe assembly. The spine 13 provides the attachment points for truck assemblies 14. The spine 13 can be a tubular member, a solid monolithic structure, or of any other suitable form. The spine 13 should be selected to provide rigidity and durability of the device. The spine 13 can be formed with a slight upward bend to counteract any deflection from the rider's weight or forces exerted by the rider, and to allow for suitable connections to the truck assemblies 14 at an angle appropriate for turning.

Each truck assembly 14 is securely attached to one end of the spine 13. The truck assembly 14 typically will have two skate wheels 18 attached at its ends. The truck assembly 14 can be made from cast, milled, or molded metals, as well as other materials. The truck assembly 14 also serves as an attachment point for a spring member 15, which is also connected to deck 11. Spring members 15 can connect to any point on the deck 11 or truck assemblies 14, but typically a spring member 15 will be connected at each end of the deck 11 connecting the proximate end of the deck 11 with the respective truck assembly 14. The device 10 can be manufactured such that the spring member 15 can be attached to different points on the deck 11 and truck assembly 14 to alter the flexibility characteristics and modify the jumping and ride quality of the device 10.

A variety of fastening means can be used to connect each end of spring member 15 to the deck 11 and the truck assembly 14, including ball socket joints, stud mounts, rod and brackets, bar pins, eye mounts, and clevis rod ends.

Figure 3:
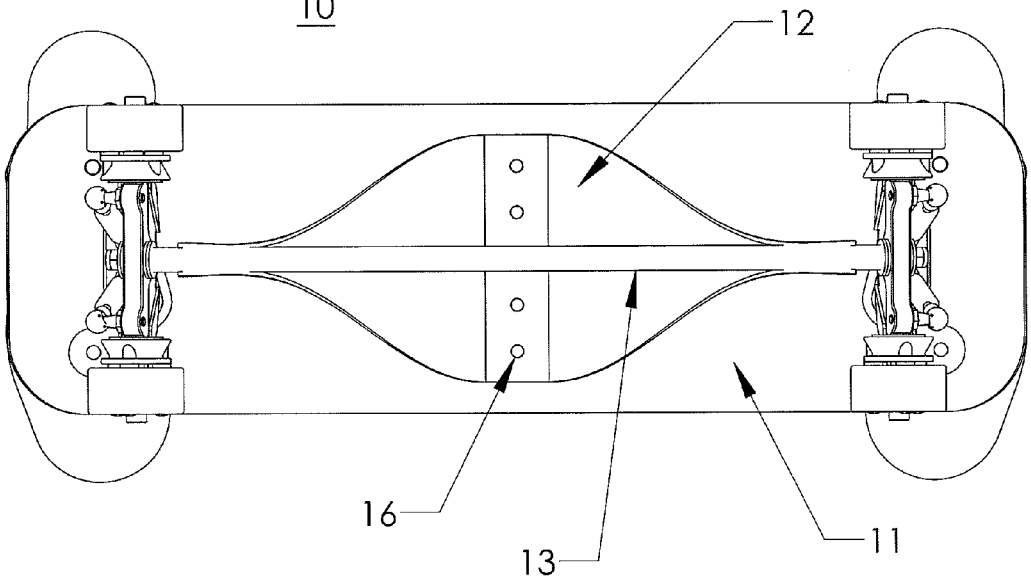
FIG. 3 is a bottom view of the device.
Figure 4:
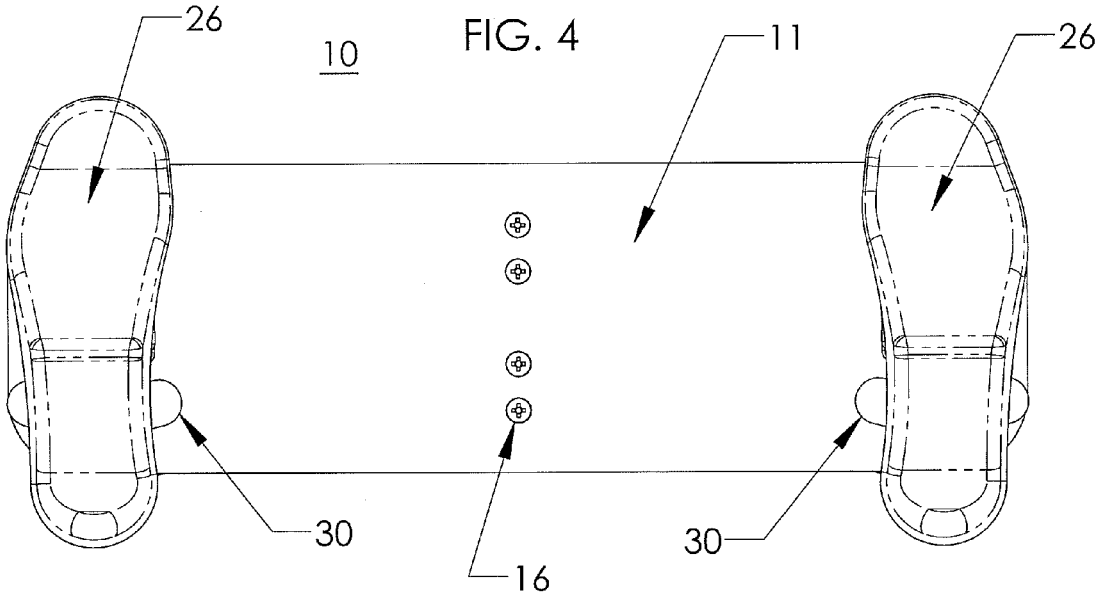
FIG. 4 is a top view of the device.

The deck 11 can be attached to the saddle 12 with fasteners 16 as shown in more detail in FIGS. 3 and 4. Any suitable fastening means may be used, including bolts, rivets, screws, as well as adhesives to securely connect the saddle 12 to the deck 11 Fasteners 16 with button head, pan head, or flat head tops are particularly suited for this application, since they provide a larger surface area with minimal protrusion. Any number of fasteners 16 or combination of fasteners 16 can be used to provide the required level of secure attachment. Rubber grommets (not shown) may be used in conjunction with the fasteners 16 to protect the deck 11 from wearing on the fasteners 16 or saddle 12, and to reduce vibrations transmitted from the riding surfaces.

Referring to FIG. 4, heel plate 30 provides an area that supports the heel portion of the footwear 26. The heel plate 30 can also help keep the bottom of footwear 26 parallel to the top surface of the deck 11. Heel plate 30 can be replaced as needed due to wear and can be made of plastic, wood, aluminum, or any other suitable material. The finish texture of the top of the heel plate 30 can range from a smooth surface, which easily allows the rider to pivot his feet, to a rough texture that increases the friction between the heel plate 30 and footwear 26.

In place of heel plate 30, a pivot guide (not shown) can be incorporated into the deck 11 which would provide a track or channel for the heel portion of footwear 26 to move in an arc while remaining securely fastened to deck 11. A pivot guide would limit the length of travel for the heel portion of footwear 26. A pivot guide pin (not shown) can be used in conjunction with the pivot guide and would help retain the footwear 26 to the deck 11. A pivot guide pin could be T-shaped or have a flanged head and would be affixed to the underside of footwear 26 and travels in the pivot guide.

FIG. 5 shows the brakes 17 which can be used to stop the skate wheels 18 from turning. While any type of brake 17 can be used to stop the rotation of skate wheel 18, a cone and cup style brake is particularly suited for this application since it can be lightweight, compact in design, and is engaged by simple mechanical actuation. It is important that the brake 17 of each wheel of a particular truck assembly 14 be applied in unison and uniformly at each skate wheel 18 to prevent the device from shifting and causing the rider to fall off.

Figure 6:
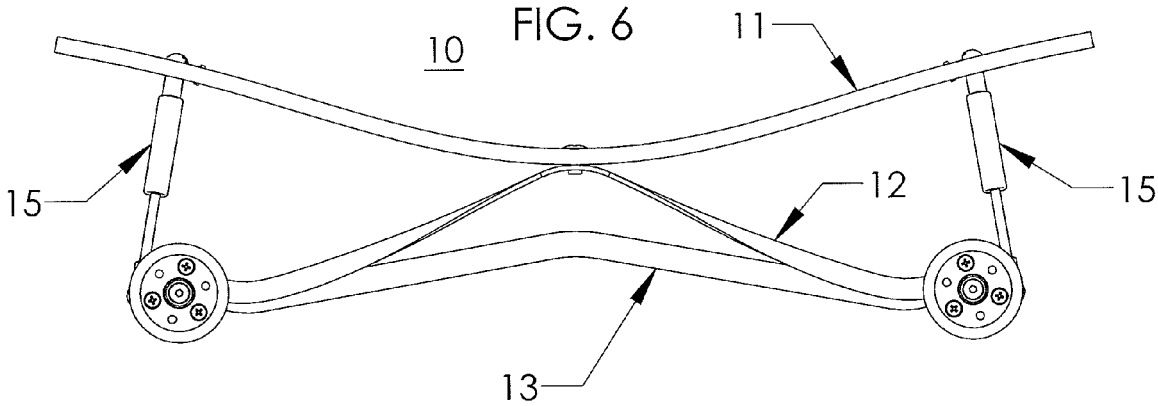
FIG. 6 is a side view of the device with fully extended springs.
Figure 7:
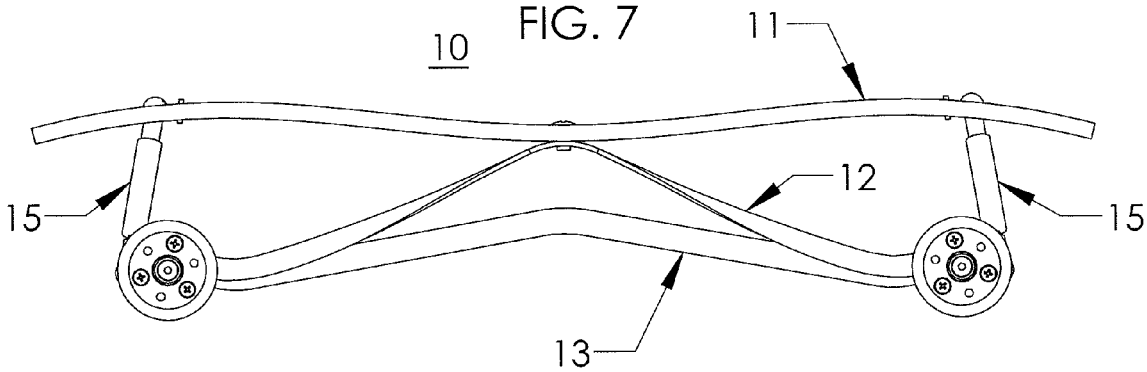
FIG. 7 is a side view of the device with compressed springs.

FIG. 6 shows the deck 11 with each spring member 15 in a fully extended position, while FIG. 7 shows each spring member 15 in a fully compressed position. FIG. 7 shows an embodiment of the invention after a rider (not shown) has flexed the deck 11 as if to prepare for a jump or when landing from a drop-off. When each spring member 15 is fully compressed, the device has stored the maximum amount of energy which can be rapidly released to propel the device and the rider upwards.

Figure 8:
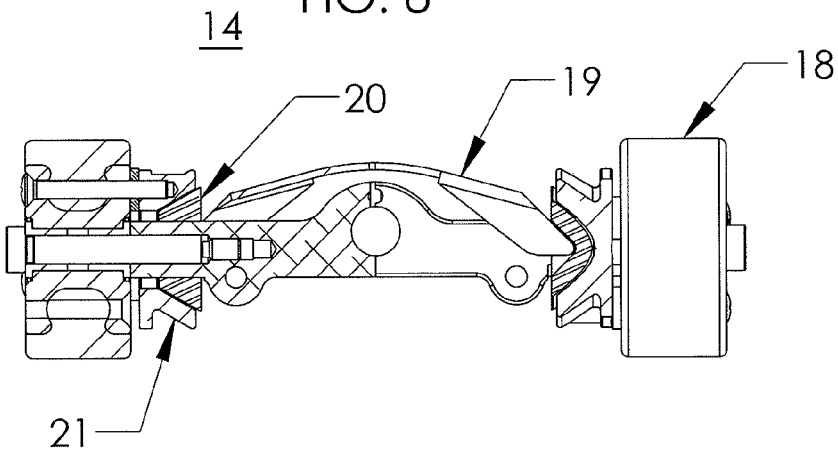
FIG. 8 is a cut away view of the truck assembly and wheels.
Figure 9:
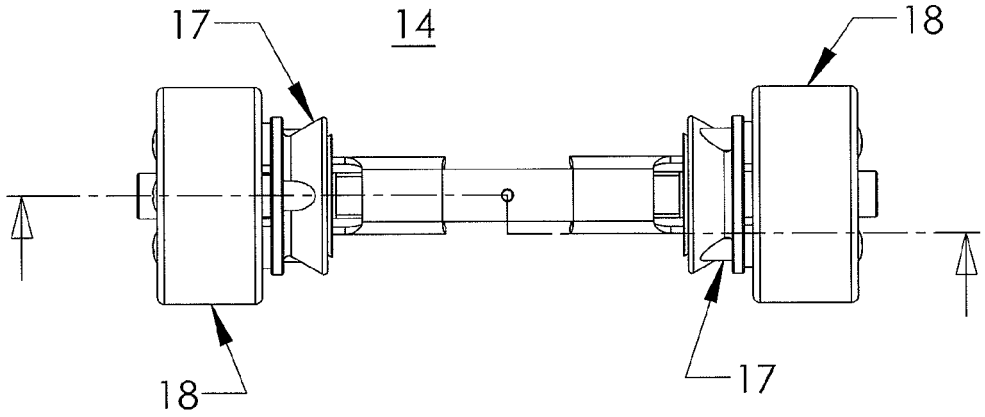
FIG. 9 is a top view of the truck assembly and wheels.
Figure 10:
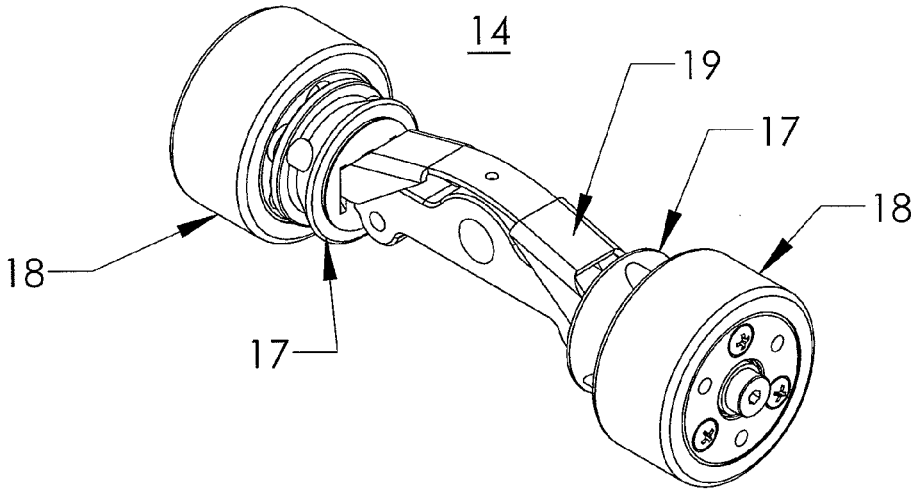
FIG. 10 is an isometric view of the truck assembly and wheels.

FIGS. 8, 9, and 10 show the truck assembly 14 removed from the device 10. In this embodiment, the truck assembly 14 is fitted with a brake 17 which is a cone and cup style brake. The brake actuator 19 can be pressed downwardly toward the truck assembly 14, which in turn pushes the brake cone 20 into the brake cup 21. The brake cone 20 is attached to the truck assembly 14 in a manner that allows axial movement but not rotation, and the brake cup 21 is securely attached to the skate wheel 18. When the brake actuator 19 is released, the brake cone 20 retracts from the brake cup 21 and allows the skate wheel 18 to freely spin.

Unlike most skate wheels which are free spinning rollers and are incapable of transmitting torque, skate wheels 18 are capable of transmitting a torque. When the brake 17 is applied, the skate wheel 18 transmits the torque braking force from the brake 17 through the tire 25 and then to the ground. The skate wheel 18 can also function as a drive wheel by attaching a sprocket in place of the brake cup 21 and connecting the sprocket to a motor. When used as a drive wheel, the skate wheel 18 transmits the torque applied to the sprocket through the tire 25 and then to the ground.

Figure 11:
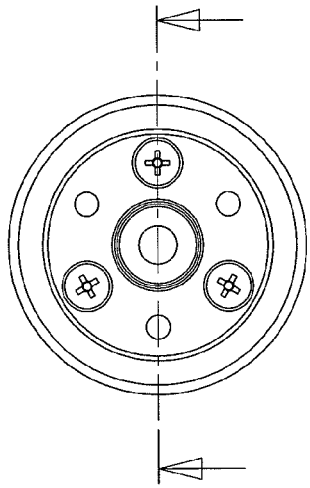
FIG. 11 is a side view of a wheel.
Figure 12:
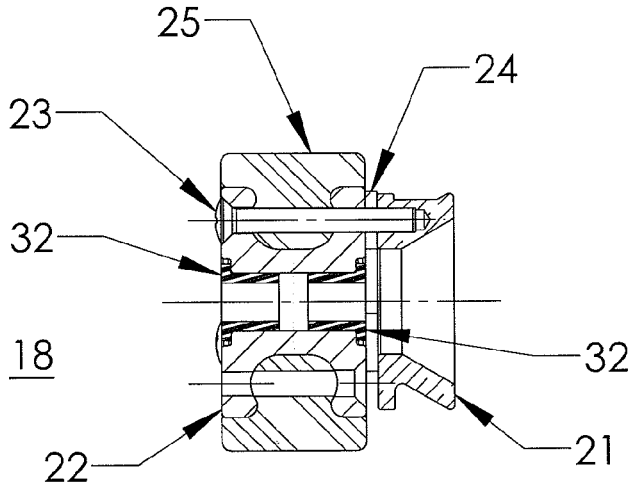
FIG. 12 is a cut away front view of a wheel.
Figure 13:
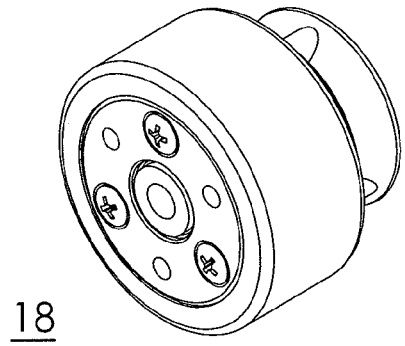
FIG. 13 is an isometric view of a wheel.

FIGS. 11, 12, and 13 show one embodiment of the skate wheel 18, which is comprised of a tire 25 held in place with one of two symmetrical hub halves 22 on each side of the tire that are connected together with fasteners 23. The symmetrical hub halves 22 can be made of metal, plastic, or other suitable rigid materials. The advantages of making the hub halves symmetrical include a reduction in spare parts and manufacturing efficiencies related to producing less part numbers. A tire 25 is fitted between the hub halves 22 and is partially held in place by the tire profile matching the inner profile of the hub halves 22. Additionally, the fasteners 23 may extend through the tire 25, and draw the two hub halves 22 tightly together to slightly compress the tire 25. The outer shoulder of the tire 25 can be extended to be flush with the face of the hub half 22, which helps to protect the outer circumference of the hub half 22. The tire 25 can be made of polyurethane, rubber, other elastomeric materials, or combinations thereof.

As described above, brake cup 21 is connected to the skate wheel 18 with fasteners 23. During braking operation, the brake cup 21 can generate significant heat, so a thermally insulating washer 24 can be inserted between the brake cup and the hub half 22 to prevent heat transfer, which may otherwise affect the performance of the tire 25. Additionally, cooling fins or ribs may be incorporated into the design of brake cup 21 to further dissipate heat. The washer 24 can be made of ceramic, plastic, wood, composite material, or other suitable insulating material.

Figure 14:
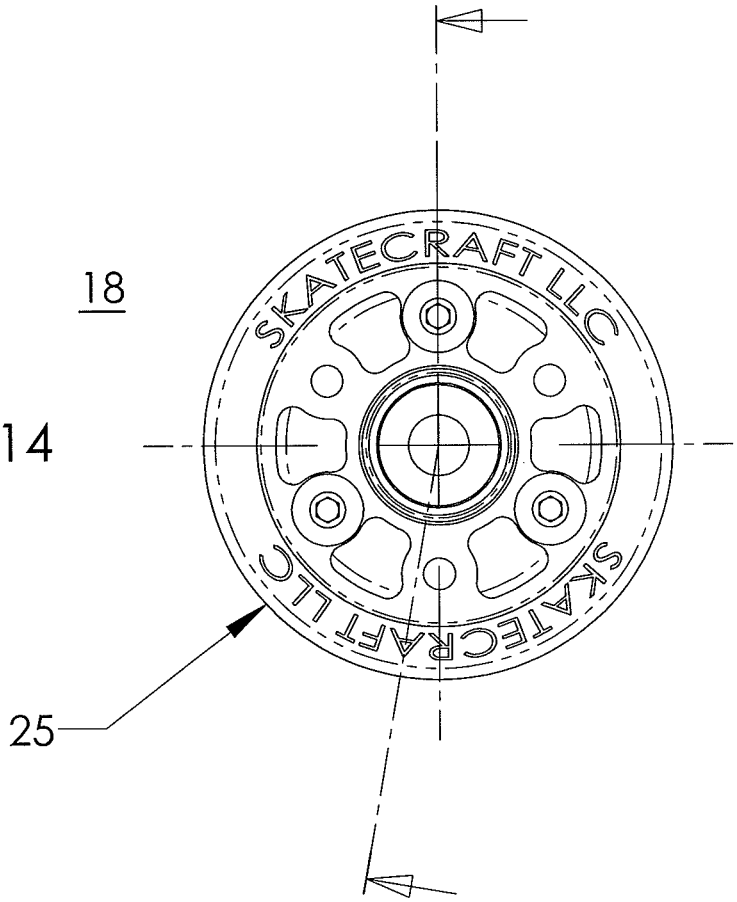
FIG. 14 is a side view of a wheel.
Figure 15:
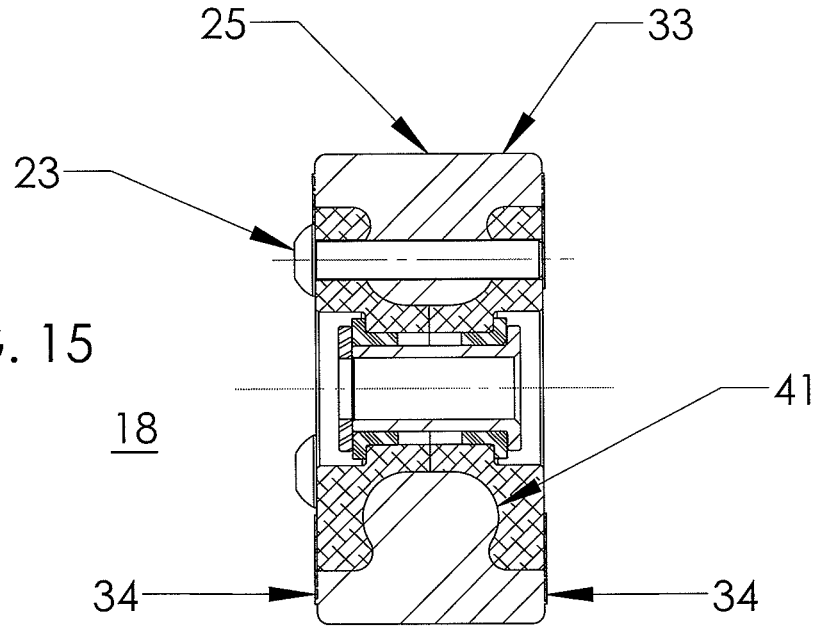
FIG. 15 is a side front cut away view of a wheel.
Figure 16:
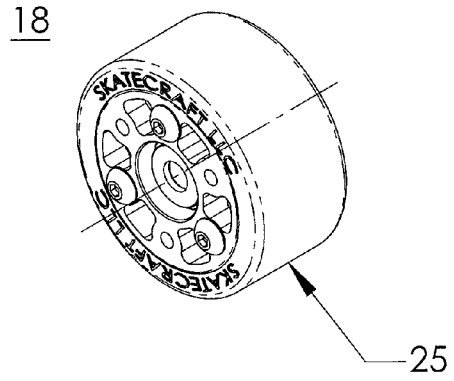
FIG. 16 is an isometric view of a wheel.
Figure 17:
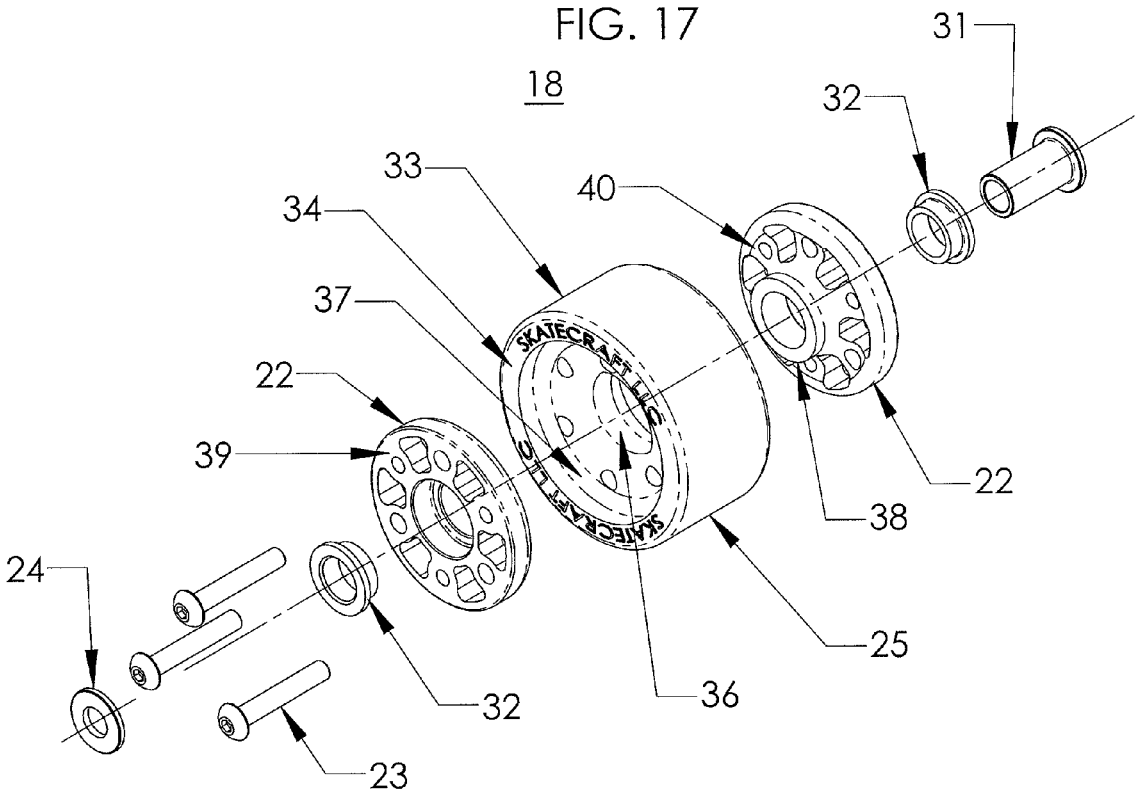
FIG. 17 is an exploded isometric view of a wheel.

FIGS. 14, 15, and 16 are embodiments of the skate wheel 18 shown without a brake. FIG. 15 is a cut away view of skate wheel 18 showing in more detail the riding surface 33, the sides 34, and the bulge 41 of the tire 25. Bulge 41 helps to retain tire 25 within the two hub halves FIG. 17 shows the individual components that comprise one embodiment of the skate wheel 18 as shown in FIGS. 14, 15, and 16. The skate wheel 18 is designed to allow a user to quickly disassemble the skate wheel 18 and replace the tire 25, hub halves 22, bearings 32, or spacer 31. The quick disassembly and interchanging of parts allows a user to adjust the skate wheel 18 to the ground surface or repair parts quickly. Each hub half 22 has a protruding center 38, an inner face 40, and an outer face 39. The tire 25 comprises a riding surface 33, two sides 34, and a hole 36 through its center. Each side 34 has an indentation 37 into each of which fits one hub half 22, such that the centers 38 of the hub halves 22 contact each other to provide a solid channel into which spacer 31 and bearings 32 fit. The indentations 37 allow hub halves 22 to be inserted into tire 25, thus protecting the hub halves 22 from the ground surface and allowing the outer faces 39 of the hub halves 22 to be flush with the respective sides 34 of the tire 25. The indentations 37 can vary in width from the inner diameter of the tire 25 to the outer diameter. In the preferred embodiment, as shown in FIG. 15, the indentations 37 are narrower towards the interior of the skate wheel 18 than toward the riding surface 33 of the tire. This profile creates a bulge 41 in the tire 25 to aid in the retention of the tire 25 between hub halves 22. The profile of the indentations 37 in this embodiment matches the inner profile of the corresponding hub halves 22. The matching profiles between the indentations 37 and hub halves 22 hold the tire 25 and hub halves 22 substantially together to prevent slipping.

Two symmetrical hub halves 22 are fitted together on each side of tire 25. Fasteners 23 extend through the outer face 39 of a first hub half 22, then though the tire 25, and into the inner face 40 of a second hub half 22. Fasteners 23 can be bolts, screws, rivets, or any other suitable fasteners. A hub half 22 can have any number of holes through which any number of fasteners are inserted and secure to the other hub half 22. In the preferred embodiment, each hub half 22 has six holes with alternate holes being threaded to accept a fastener 23. Only three fasteners 23 on the facing side of skate wheel 18 are shown. This embodiment will also have three additional fasteners on the far side of the skate wheel 18 that are not shown.

A spacer 31 can be used to properly position bearings 32 about the truck assembly axle (not shown). The spacer 31 can be appropriately sized to fit a variety of axle sizes without the need to change bearings 32 or any other component of the skate wheel 18. The spacer 31 has precision ground outer-diameter face for bearings 32 to rotate about leading to improved skate wheel 18 performance and reduced bearing 32 failures.

Bearings 32 can be plain, needle, ball, or any other suitable type of bearing and can be made of plastic, steel, aluminum, bronze, or any other suitable material. Depending on the type of bearing selected, lubrication may be necessary. Flanged, plain bearings are particularly suited for application with the skate wheel 18 since the flange face provides for an additional bearing area between hub half 22 and corresponding washer 24. Washers 24 can be used to appropriately space the skate wheel 18 on the truck assembly axle (not shown) and can provide increased-surface-load area when the truck assembly axle nut (not shown) is tightened. Washers 24 can be made of plastic, steel, aluminum, bronze or any other suitable material.

Figure 18:
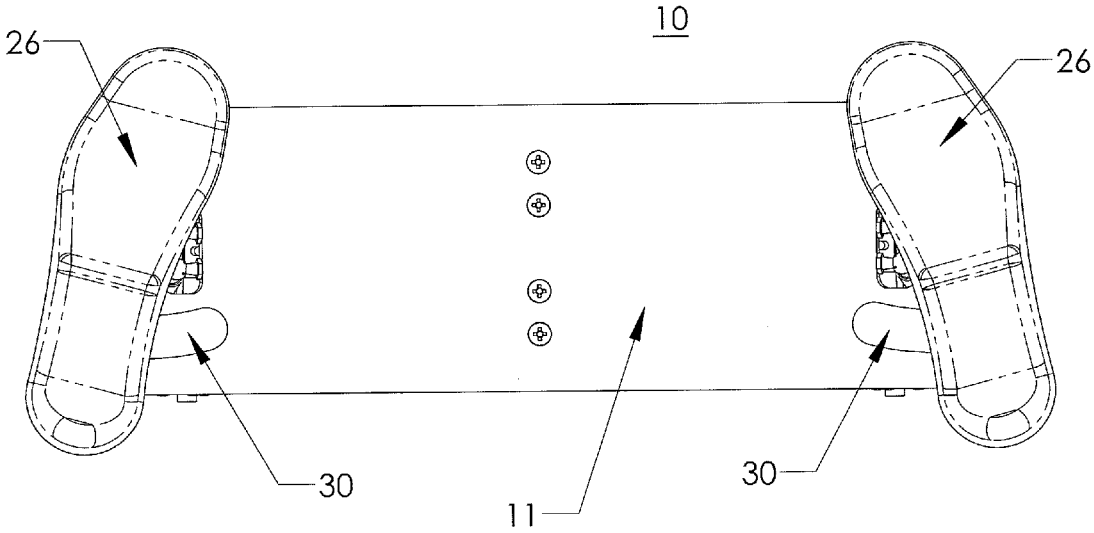
FIG. 18 is a top view of the device.
Figure 19:
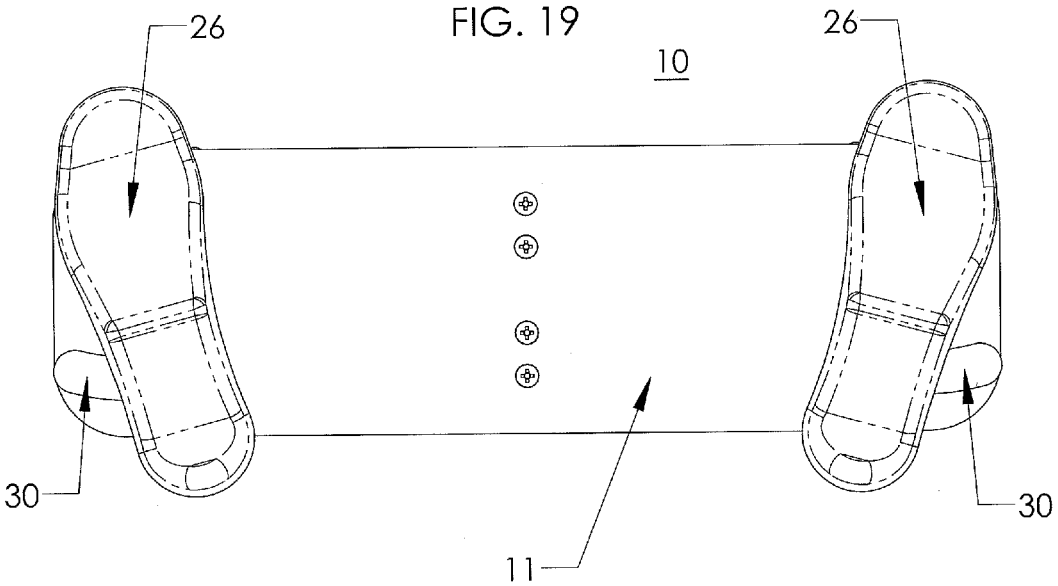
FIG. 19 is a top view of the device.

FIGS. 18 and 19 show the device 10 with the attached footwear 26 configured to pivot about the toe portion of the footwear 26. It is also possible to configure the footwear 26 so that the pivot point is about the heel portion of the footwear 26. FIG. 18 shows the footwear 26 pivoted in the maximally outwards position. FIG. 19 shows the footwear 26 pivoted in the maximally inwards position of the pivot.

Figure 20:
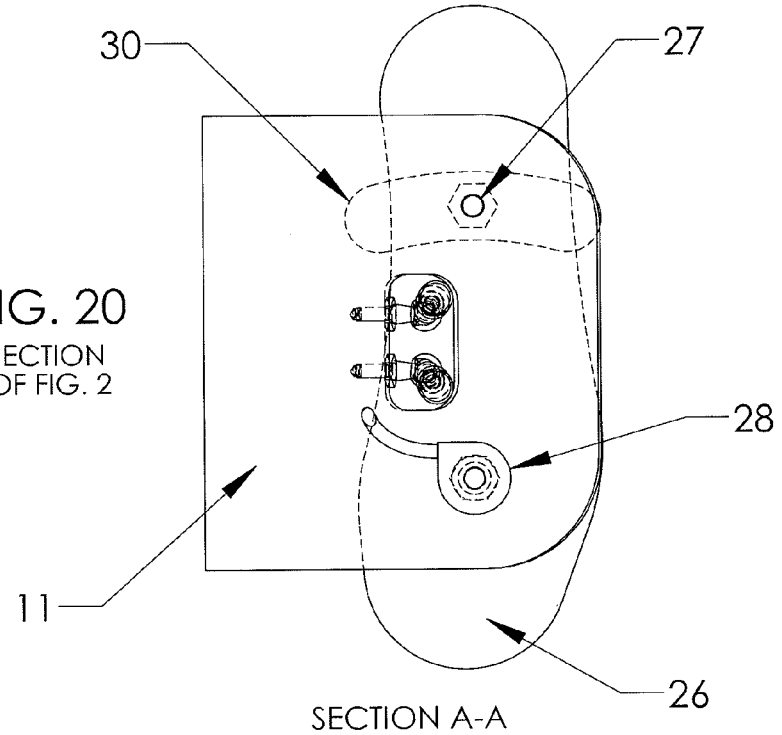
FIG. 20 is a partial bottom view of the device.

FIG. 20 shows the footwear 26 in phantom above a partial view of the deck 11. The pivot cam 28 is attached to the deck 11 and is also attached to the bottom of footwear 26. The heel plate 30 in phantom is securely attached to the top of the deck 11 with heel plate fastener 27. Heel plate fastener 27 can be a bolt, screw, rivet, or any other suitable fastener.

Figure 21:
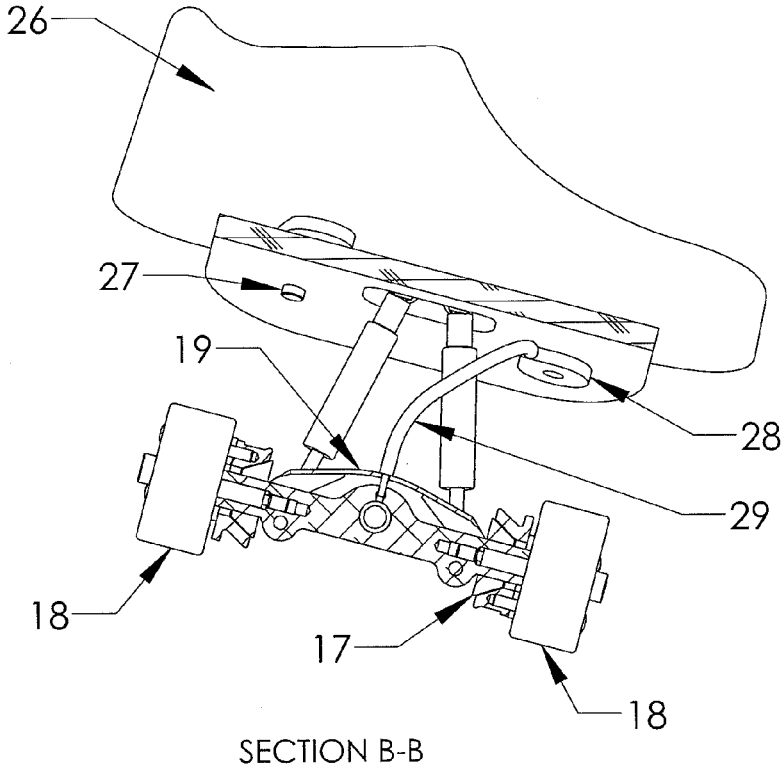
FIG. 21 is a cross-sectional, front view of the device.

FIG. 21 shows a cross section of the device 10. Brake cable 29 is attached at one end to pivot cam 28, and at the other end to brake actuator 19. The brakes 17 can be applied by the rider pivoting his footwear 26, which actuates pivot cam 28 to pull a brake cable 29 which engages the brakes 17 through the brake actuator 19. The application of the brakes 17 helps prevent the device from accidentally slipping out from underneath the rider when the rider is bending the deck 11. Alternative embodiments may include the brake cable 29 being actuated by the rider's hand instead of the rider's foot. For instance the rider may hold a pistol grip style actuator which he can squeeze to pull the brake cable 29 tight, and engage the brakes 17 though the brake actuator 19. The brake cable 29 could also be integrated into protective gloves such that the rider making a fist pulls the brake cable 29.

It will be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A wheel consisting essentially of:

two substantially symmetrical hub halves each having a protruding center, an inner face, and an outer face, wherein the hub halves are made of a rigid material; a tire having a riding surface, two sides, an interior and a hole through its center, each side of the tire having an indentation into which fits one hub half, such that the protruding centers of each hub half are in contact with each other, wherein the indentation is narrower towards the interior of the tire than towards the riding surface such that a bulge is created in the tire; and at least one bolt is connecting the hub halves whereby the tire is firmly retained between the hub halves.

2. The wheel of claim 1, wherein the hub halves are made of aluminum.

3. The wheel of claim 1, wherein the bolt runs through the sides of the tire.

4. The wheel of claim 1, wherein the tire is made of rubber or plastic.

5. The wheel of claim 1, wherein a brake comprising a brake cone, a brake cup and a thermally insulating washer positioned between the wheel hub and the brake cup is connected to the wheel hub.

6. The wheel of claim 1 wherein the riding surface of the tire has a tread.

7. A wheel consisting essentially of:

a first bearing and a second bearing: two hub halves each having a center, an inner face, and an outer face, wherein the center of at least one of the hub halves is protruding through the wheel such that the first bearing and the second bearing are assembled into one bore, and wherein the hub halves are made of a rigid material; a tire having a riding surface, two sides, an interior, and a hole through its center, each side of the tire having an indentation into which fits one hub half, such that the centers of each hub half are in contact with each other, wherein each indentation is narrower towards the interior of the tire than towards the riding surface such that a bulge is created in the tire; and at least one bolt is connecting the hub halves whereby the tire is firmly retained between the hub halves.

8. The wheel of claim 7, wherein the hub halves are made of aluminum.

9. The wheel of claim 7, wherein the bolt runs through the sides of the tire.

10. The wheel of claim 7, wherein the tire is made of rubber or plastic.

11. The wheel of claim 7, wherein a brake comprising a brake cone, a brake cup and a thermally insulating washer positioned between the wheel hub and the brake cup is connected to the wheel hub.

12. The wheel of claim 7, wherein the riding surface of the tire has a tread.

* * * * *